US006763891B2

(12) United States Patent
Humphrey et al.

(10) Patent No.: US 6,763,891 B2
(45) Date of Patent: Jul. 20, 2004

(54) PRODUCTION TREE WITH MULTIPLE SAFETY BARRIERS

(75) Inventors: Bernard Humphrey, Potterton (GB); Jeffrey P. Goetz, Inverurie (GB); Kevin L. Ingram, Aberdeen (GB); Norman Brammer, Aberdeen (GB); Robert K. Voss, Jr., Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/201,704

(22) Filed: Jul. 23, 2002

(65) Prior Publication Data

US 2003/0019632 A1 Jan. 30, 2003

Related U.S. Application Data

(60) Provisional application No. 60/308,343, filed on Jul. 27, 2001.

(51) Int. Cl.[7] ..... E21B 33/035

(52) U.S. Cl. ..... 166/368; 166/382; 166/88.1; 166/95.1

(58) Field of Search ..... 166/368, 382, 166/88.1, 88.4, 95.1, 86.1, 97.1, 95.14

(56) References Cited

U.S. PATENT DOCUMENTS 5,544,707 A * 8/1996 Hopper et al. ..... 166/382
5,988,282 A 11/1999 Jennings et al.
6,039,119 A * 3/2000 Hopper et al. ..... 166/368
6,050,339 A * 4/2000 Milberger ..... 166/368
6,062,314 A * 5/2000 Nobileau ..... 166/368
6,186,237 B1 2/2001 Voss, Jr. et al.

FOREIGN PATENT DOCUMENTS

| | | |
|---|---|---|
| GB | 2319795 | 6/1998 |
| GB | 2320513 | 6/1998 |
| GB | 2321658 | 8/1998 |
| GB | 2346630 A | 8/2000 |
| GB | 2347703 | 9/2000 |
| GB | 2358207 | 7/2001 |
| WO | WO 96/07812 | 3/1996 |

* cited by examiner

*Primary Examiner*—Roger Schoeppel
(74) *Attorney, Agent, or Firm*—Bracewell & Patterson, L.L.P.

(57) ABSTRACT

The wellhead assembly has a production tree with multiple safety barriers. A tubing hanger lands and seals in the bore of the tree. The tubing hanger has a lateral production flow passage that registers with a lateral passage in the tree. A tubing annulus passage extends upward from the tubing annulus to an exterior port. A second portion of the tubing annulus passage extends upward from the exterior port into the bore above the tubing hanger seal. The external port may be used for gas injection. If so, two closure members are located in the upper portion of the tubing annulus above the seal. The upper closure member may be either a check valve or a removable plug.

32 Claims, 6 Drawing Sheets

PRODUCTION TREE WITH MULTIPLE SAFETY BARRIERS

This application claims priority from the provisional application Serial No. 60/308,343, filed Jul. 27, 2001 entitled "Production Tree With Gas Injection Feature".

BACKGROUND OF THE INVENTION

1. Field of the Invention

This invention relates in general to wellhead assemblies, and in particular to a production tree with multiple safety barriers against excessive pressure.

2. Description of the Prior Art

One type of wellhead assembly particularly in a subsea well includes a wellhead housing located at the upper end of conductor pipe. Casing hangers for supporting the casing land in the wellhead housing. After the well has been drilled to total depth, a Christmas tree is lowered onto and connected to the wellhead housing.

A tubing hanger lands in the tree in one type, called a horizontal tree. The tubing hanger is secured to a string of tubing that extends into the well for producing well fluids. The tubing hanger has an axial passage for production fluids, and a lateral passage extending from it that registers with a lateral passage in the tree.

During installation of the tubing and tubing hanger and other operations, it may be necessary to circulate well fluid between the interior of the tubing and the tubing annulus. The horizontal tree has a first tubing annulus passage that extends from the tubing annulus to a port on the exterior of the tree. A second tubing annulus passage extends from the exterior port back into the bore of the tree above the tubing hanger seals. A flow line is connected to the external port for delivery of fluids to and from the tubing annulus. Both the first and second tubing annulus passages in the tree have hydraulically controlled valves for opening and closing the tubing annulus passage. A internal tree cap is typically installed in the bore of the tree above the tubing hanger.

The upper end of the second tubing annulus passage may join the bore of the tree between the tubing hanger and the internal tree cap, or it may lead into the tree bore above the internal tree cap. The junction of the second tubing annulus passage with the tree bore allows communication with a riser during installation and workover. Normally, the riser connects to an exterior profile on the tree. After removal of the internal tree cap, an inner riser, such as a drill string or tubing, will be run through the outer riser and stabbed into the tubing hanger to communicate with the interior of the string of production tubing. The tubing annulus passage communicates with the annular space in the tree bore surrounding the inner riser. A choke and kill line alongside the outer riser normally provides a flow path from the surface platform to the annular space in the tree bore.

To meet safety requirements, two safety barriers are required for each passage in a wellhead assembly that may be under pressure. For the tubing hanger production passage, a removable plug is installed in the axial passage of the tubing hanger above the lateral passage to provide one safety barrier. In the prior art, typically the internal tree cap provided the second safety barrier. While workable, an internal tree cap requires a large seal that is fairly expensive. Also, if the second tubing annulus passage leads into the bore above the internal tree cap, there would be only one safety barrier in the tubing annulus above the lateral production port. If gas is being injected into the external port of the tubing annulus for gas lift purposes, a good practice would require an additional safety barrier.

U.K. patent application GB 2346630 discloses two removable plugs in the tubing hanger above the lateral passage. The upper plug could comprise a second safety barrier, eliminating the need for an internal tree cap that seals. The patent application discloses a test port that leads from the space between the plugs for monitoring leakage past the lower plug.

SUMMARY OF THE INVENTION

The wellhead assembly of this invention has a production tree or wellhead with a bore into which a tubing hanger lands and is sealed by a tubing hanger seal. A first portion of a tubing annulus passage extends upward through the tree to an exterior port. The port is adapted to be connected to a source of gas for injection into the tubing annulus. A second portion of the tubing annulus passage extends upward from the exterior port into the bore of the tree. A valve is located in the first portion of the tubing annulus passage. Two closure members are located in the second passage, providing two safety barriers for the exterior port if used to inject gas.

At least one of the closure members is a valve, preferably the lower one. The upper closure member is a removable plug in one embodiment. The plug extends into the portion of the second tubing annulus passage where it enters the bore. The plug may be accessible by an ROV through a corrosion cap that lands on the production tree.

Alternately, the upper closure member may be a shuttle type valve that is located in an axial portion of the second tubing annulus passage within the sidewall of the tree mandrel. In one embodiment, this valve is a check valve that is biased upward to a closed position. In the closed position, a stem of the valve protrudes above a rim of the production tree. When a riser connector lands on and connects to the tree, the riser connector will move the stem downward, opening the second tubing annulus passage into the bore of the tree.

The internal tree cap may be eliminated as a second safety barrier for the production passage in the tubing hanger. The second safety barrier could be provided by a removable plug located in the axial passage of the tubing hanger. Venting is provided by a vent passage that leads to an exterior of the tubing hanger. A mating passage extends through the tree and mates with the vent passage of the tubing hanger.

If desired, a secondary locking mechanism may be mounted above the tubing hanger to prevent an upward movement of the tubing hanger in the event the tubing hanger primary lockdown fails. The secondary lockdown would not require any seals for sealing to the bore of the tree. The secondary lockdown may also be utilized to connect with a small diameter wireline riser. The wireline riser engages a neck on the secondary lockdown and has a stinger that extends into sealing engagement with the axial passage in the tubing hanger.

DETAILED DESCRIPTION OF THE PREFERRED EMBODIMENT OF THE PRESENT INVENTION

Figure 1:
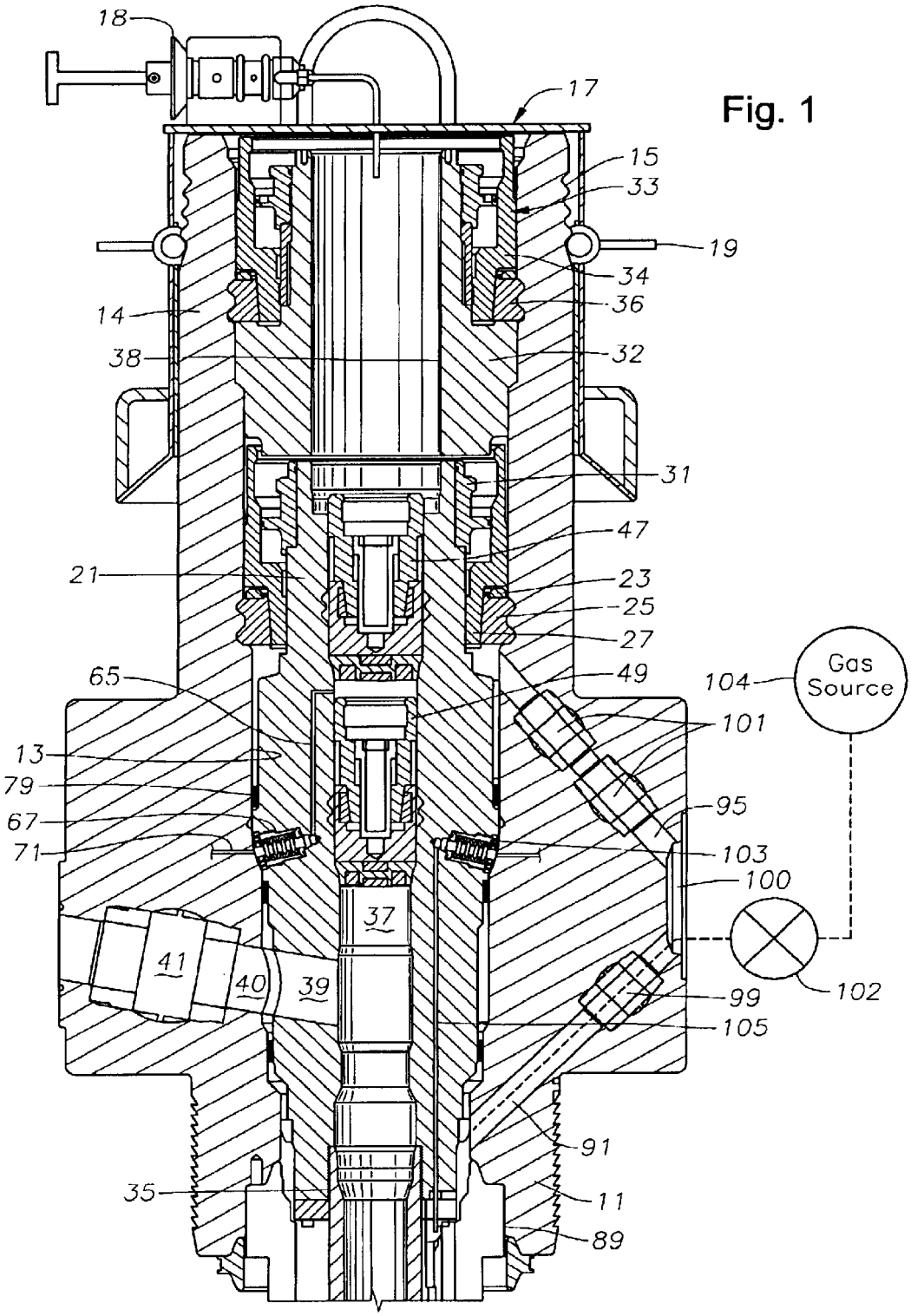
FIG. 1 is an enlarged sectional view of a horizontal tree in accordance with this invention with only one-half of an internal tree cap shown.

Referring to FIG. 1, production tree 11 is of a type known as a horizontal tree. The word "tree" is used broadly herein to include other variations of tubular members or wellheads located at the upper end of the well. The word "tree" is meant to also encompass a wellhead member through which at least some of the drilling may occur, which has a tubing hanger landed therein, and a lateral production flow passage. In this embodiment, tree 11 is mounted to a wellhead housing (not shown) and is typically installed after the well has been drilled and cased. Tree 11 has a vertical or axial tree bore 13 extending completely through it. The upper portion of tree 11 is a cylindrical member or mandrel 14 with a set of grooves 15 located on the exterior for connection to a drilling riser (not shown).

A removable corrosion cap assembly 17 is installed on the upper end of tree 11 after the riser is removed. A lockdown lever 19 engages grooves 15 to secure corrosion cap assembly 17 to tree 11. Although corrosion cap 17 is not sealed to tree 11, for safety, a manually operable vent apparatus 18 may be mounted to corrosion cap 17 to prevent any pressure buildup prior to releasing lever 19.

A tubing hanger assembly 21 lands in bore 13 and is secured to tree 11 by a tubing lockdown mechanism 23. Lockdown mechanism 23 includes a lockdown split ring 25, which is pushed outward by a central cam member 27. Split ring 25 has a grooved profile for engaging mating grooves in tree bore 13. Cam member 27 has a profile 29 on its upper end for engagement by a running tool. Cam member 27 moves between a lower locked position shown and an upper released position, freeing split ring 25 to retract. A retainer 31 secures to the upper end of tubing hanger assembly 21 to retain cam member 27.

In the configuration shown in the right half of FIG. 1, tubing hanger assembly 21 is also secured against upward movement by a secondary tubing hanger lockdown assembly 33 that is actuated in the same manner as the primary lockdown 23. Secondary lockdown assembly 33 includes a body 32, which has an extended shoulder that lands on a shoulder in bore 13. Neither body 32 nor any other portion of lockdown assembly 33 is sealed in bore 13. Body 32 carries a cam sleeve 34 and a split ring 36. Split ring 36 engages a grooved profile in bore 13 when cam sleeve 34 is moved downward. An axial bore 38 extends through body 32. A flange 30 is rigidly mounted on the upward extending neck of body 32, defining an exterior profile for the neck. Secondary lockdown assembly 33 is optional, as indicated in the left side of FIG. 1.

Referring to FIG. 1, a string of production tubing 35 extends from tubing hanger 21 through the casing hangers (not shown) into the well for the flow of production fluid. Production tubing 35 communicates with a vertical passage 37 extending completely through tubing hanger 21. A lateral production flow passage 39 extends generally horizontally through tubing hanger 21 from vertical passage 37 and aligns with a tree lateral passage 40. A tree valve 41 controls flow through production passage 40. Tubing hanger assembly 21 has an upper seal 43 located above lateral passage 39 and a lower seal 45 located below lateral passage 39. Seals 43 and 45 extend circumferentially around tubing hanger 21 and seal to bore 13 of tree 11.

Figure 2:
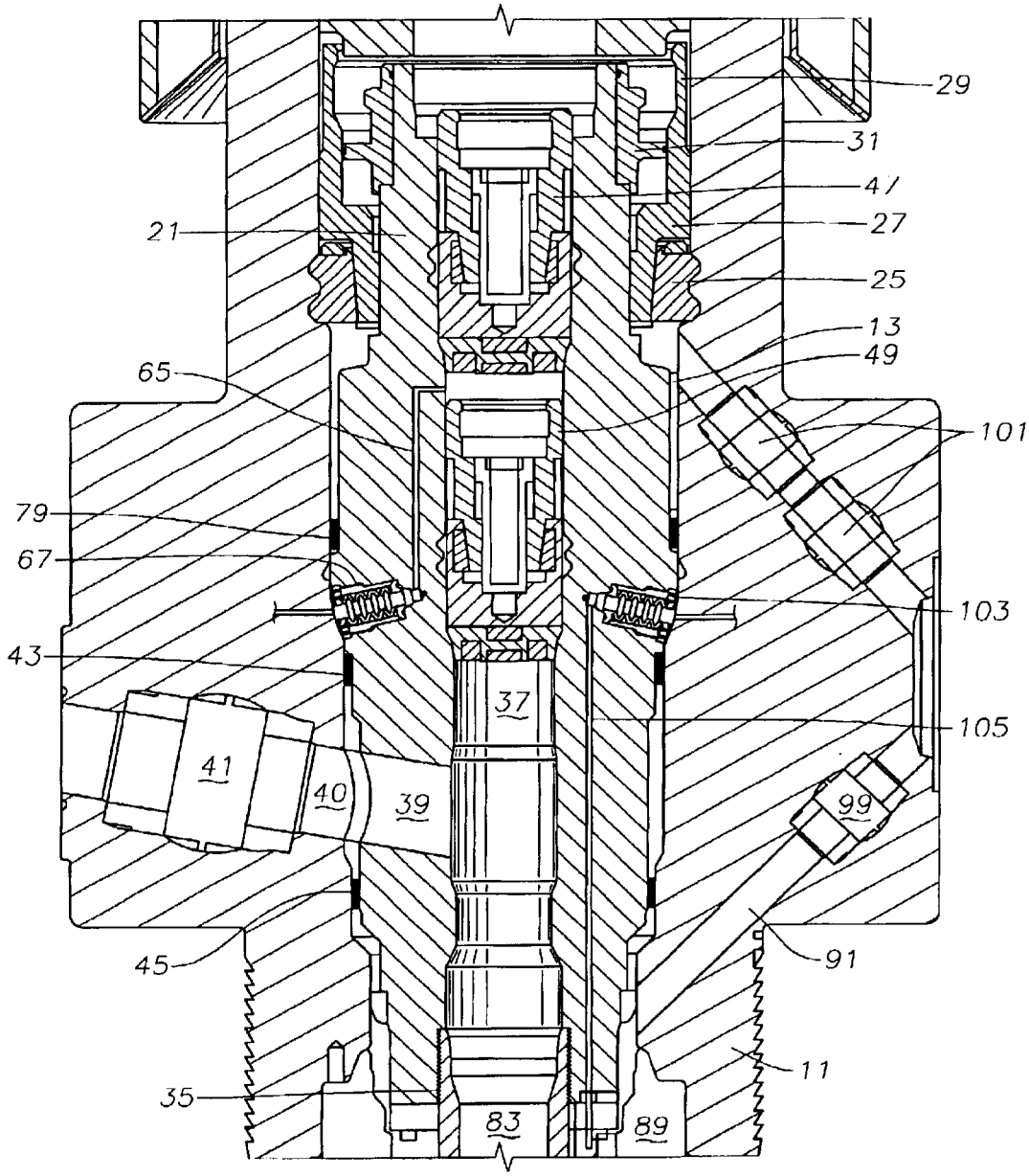
FIG. 2 is an enlarged sectional view of a central portion of the horizontal tree of FIG. 1.

Refer to FIG. 2, tubing hanger assembly 21 contains a two crown plug assemblies 47, 49 installed above lateral passage 39. Crown plug assemblies 47, 49 provide two safety barriers for tubing hanger axial passage 37. Crown plug assemblies 47, 49 are run by wireline, coiled tubing, or drill pipe, are commercially available, and insert into tubing hanger assembly passage 37. A crown plug vent passage 65 in tubing hanger assembly 21 has one end that enters tubing hanger passage 37 between crown plugs 47, 49. Vent passage 65 extends laterally through tubing hanger 21 to an exterior spherical portion of the side wall of tubing hanger 21. Vent passage 65 terminates in a port that contains a metal seal 67 that may be constructed as shown in U.S. Pat. No. 5,865,250. Other types of seals may be used, and it is not essential that vent passage 65 terminate on a spherical lateral portion of tubing hanger 21. The preferred metal seal 67 is a cylindrical member concentrically mounted in vent passage 65 for sealingly engaging tree bore 13 around a mating vent passage 71 in tree 11. Metal seal 67 has a check valve that opens once engagement is made. When upper crown plug assembly 47 is being installed, fluid trapped between lower crown plug assembly 49 and upper crown plug assembly 47 may flow out crown plug vent passage 65, through lateral seal 67, and into tree passage 71. Tree passage 71 leads from the exterior of tree 11 to the control system for tree 11 and also may be used for applying test pressure to crown plug assemblies 47, 49. Tubing hanger assembly 21 has an upper gallery seal 79 extending around it above lateral seal 67. Lower gallery seal 43 is located below lateral seal 67. Seals 79 and 43 extend around tubing hanger 21 and seal to bore 13 of tree 11.

A tubing annulus 89 surrounds tubing 35 between tubing 35 and the smallest diameter string of casing (not shown). Tubing annulus 89 communicates with a lower or first annulus passage 91 that extends from tree bore 13 through the wall of tree 11 below tubing hanger seal 45. The lower annulus passage 91 communicates with a second or upper annulus passage 95 that extends into tree bore 13 above tubing hanger seal 79. An external port 100 on the side of tree 11 is located at the junction of first and second tubing annulus passages 91, 95. Secondary lockdown assembly 33 does not contain a seal, thus any pressure from tubing annulus 89 communicated to bore 13 by upper annulus passage 95 would communicate with the entire portion of the tree bore 13 above seal 79 and upper crown plug 47. A hydraulically actuated valve 99 is located in lower annulus passage 91, and a pair of hydraulically actuated valves 101 in series are located in upper annulus passage 95 in this embodiment.

External port 100 leads to a flow line having an external valve 102. A gas source 104, such as a tank of compressed gas at the surface platform, may be connected to valve 102. The gas may be of a variety of types that are used for stimulating production by injecting the gas into tubing annulus 89. One type of gas utilized is nitrogen. When tubing annulus valves 101 in upper tubing annulus passage 95 are closed and valves 99 and 102 open, the gas flows through lower tubing annulus passage 91 into tubing annulus 89. Valves 101 provide two separate safety pressure barriers while pressure exists at port 100 and in tubing annulus 89.

Lateral ports 103 (only one shown) extend through tubing hanger 21 to communicate hydraulic fluid pressure from the exterior of tree 11 to a downhole safety valve (not shown) and for delivering fluids for other purpose. A tubing hanger hydraulic fluid passage 105 extends from port 103 through tubing hanger assembly 21 for connection to the downhole safety valve.

Refer to FIGS. 1 and 2, in operation, after the well has been drilled and cased, the operator lowers tree 11 onto the wellhead housing (not shown). Tree 11 will normally be lowered on a drilling riser (not shown) that connects to grooves 15 of tree mandrel 14. The operator then may install production tubing 35. Tubing hanger assembly 21 lands in bore 13 with its lateral passage 39 aligning with tree lateral passage 40. Tubing hanger lockdown mechanism 23 locks tubing hanger assembly 21 to tree 11. Vent passages 65, 71 register sealingly with each other. Access to tubing annulus 89 is provided through the upper end of tree bore 13, and passages 95, 91.

Once tubing hanger 21 is installed and tested, lower crown plug assembly 49 may then be installed with a wireline tool. Upper crown plug assembly 47 will then be installed with a wireline tool in tubing hanger assembly 21. Fluid trapped between lower crown plug assembly 49 and upper crown plug assembly 47 may flow out vent passage 65 into tree passage 71. The operator may test plug 49 by applying test pressure through vent passages 71 and 65. Secondary lockdown 33, if used, may be installed either before or after the installation of crown plugs 47, 49. If installed, preferably the upper end of secondary lockdown 33 is substantially flush with or lower than the upper end of tree mandrel 14. The drilling riser may be disconnected from tree 11 and removed. Corrosion cap 17 is lowered on a line and secured to tree mandrel 14 with the assistance of an ROV. Well production is through lateral passages 39, 40. Gas injection, if used, is through port 100 from gas source 104. If gas injection is not to be used, one of the tubing annulus valves 101 is not needed.

For a workover operation in which tubing 35 needs to be pulled, a drilling riser can be employed. After removal of corrosion cap assembly 17, the operator installs a drilling riser onto tree mandrel 14 by connecting it to grooves 15, the drilling riser having a blowout preventer (not shown). The operator may circulate a kill fluid to kill the well. To do so, the operator installs an inner riser string or conduit that stabs into the upper end of passage 37 of tubing hanger assembly 21 above crown plugs 47, 49. If secondary lockdown 33 is used, it may be removed first, or the operator could connect the inner riser string to secondary lockdown 33 and stab into tubing hanger 21 with a stinger as suggested in FIG. 3. Pipe rams (not shown) in the drilling riser are closed around the inner riser string. With both tubing annulus valves 101 open, upper tubing annulus passage 95 now communicates with an annulus surrounding the inner riser, which in turn communicates with choke and kill lines leading alongside the drilling riser back to the platform.

The operator will pull upper crown plug assembly 47 with a wireline tool (or other commercially available means). Vacuum pressure may be relieved via crown plug vent passage 65. The operator will then pull lower crown plug assembly 49 with a wireline tool (or other commercially available means). A port (not shown) at the lower end of tubing 35 will be opened to communicate the interior of tubing 35 with tubing annulus 89. This may be done remotely through a hydraulic line or with a wireline tool in a conventional manner. With the production valve 41 closed and lower tubing annulus valve 99 open, the operator can pump down the inner riser, down tubing 35 and back up tubing annulus 89. The annulus fluid circulates through lower annulus passage 91 and upper annulus passage 95, up tree bore 13 and through the choke and kill lines to the surface. The circulation could also be in reverse.

After the kill fluid has been placed in the well, the operator may pull production tubing 35. The operator will lower a drill string with a running tool into engagement with tubing hanger lockdown assembly 23 and retrieve it (if configured with secondary lockdown assembly 33, removal is similar).

Figure 3:
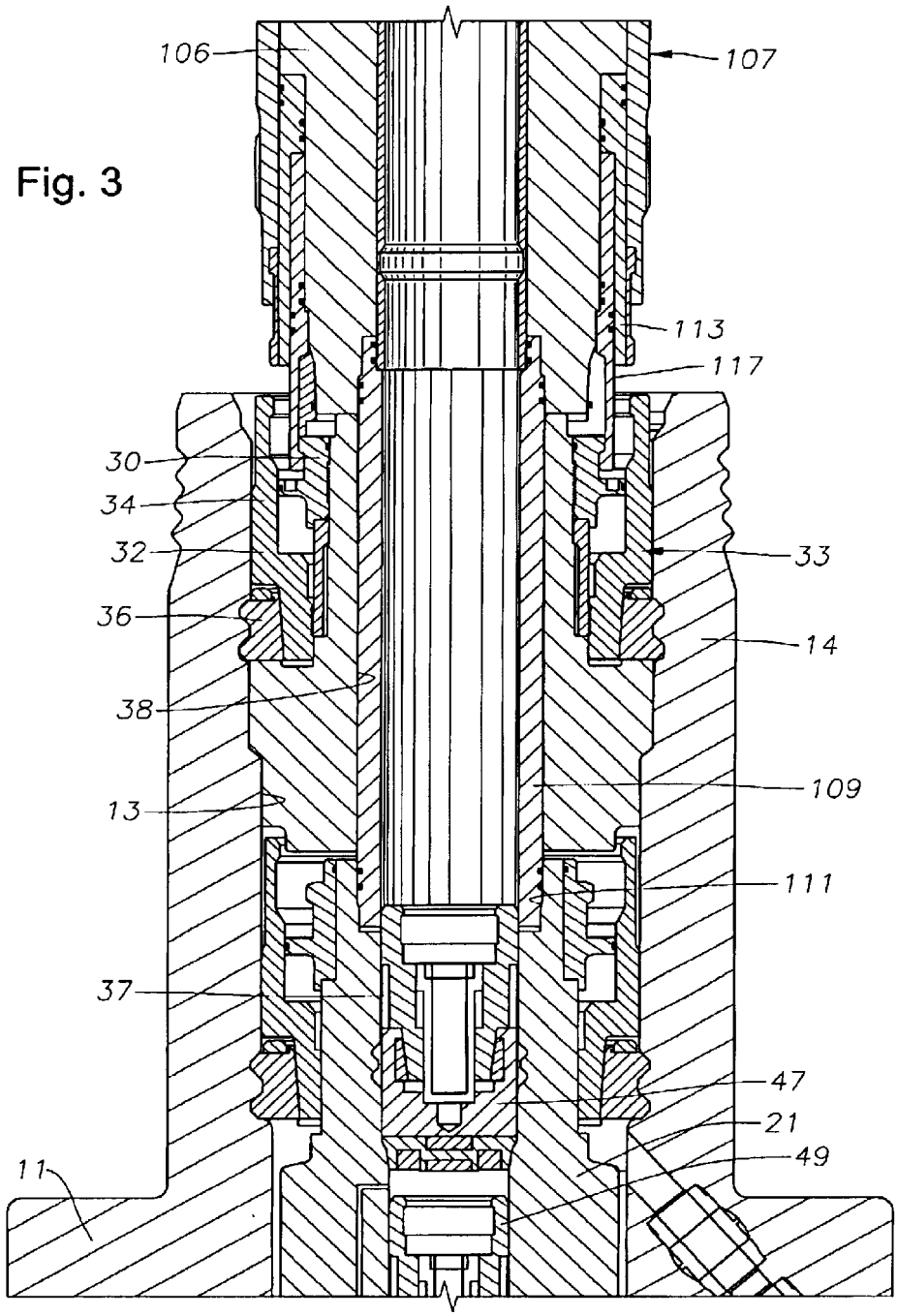
FIG. 3 is en enlarged sectional view of the horizontal tree of FIG. 1, showing a riser engaging a secondary lockdown to enable wireline access.

Under some circumstances, an operator may wish to achieve wireline or coiled tubing intervention into tubing 35 (FIG. 1) without killing the well and without using a drilling riser. Access is achievable with the well under flowing conditions as shown in FIG. 3. A small diameter light weight riser 106 has a connector 107 on its lower end. Because secondary lockdown 33 is located with its upper end substantially flush with tree mandrel 14, riser 106 and portions of connector 107 may have diameters greater than the diameter of tree bore 13. Connector 107 lands on secondary lockdown 33 and may be similar to a conventional tubing hanger running tool.

Connector 107 has a stinger 109 that extends through lockdown 33 and sealingly engages a counterbore 111 in tubing hanger 21. Connector 107 has a collet 117 that slides over and engages flange or profile 30 on the neck of secondary lockdown 33. A sleeve 113 is hydraulically moved downward around collet 117 to lock collet 117 to flange 30. Connector 107 is shown landed but not locked to lockdown 33. Other types of connectors 107 are workable.

The operator can then use a wireline tool to engage upper crown plug assembly 47. The operator will retrieve both upper and lower crown plug assemblies 47, 49, in a conventional manner to perform the wireline or coiled tubing intervention. Upper and lower crown plug assemblies 47, 49 may be reinstalled conventionally. Crown plug vent circuit 65 (FIG. 1) avoids hydraulic lock when landing upper crown plug assembly 47.

Figure 4:
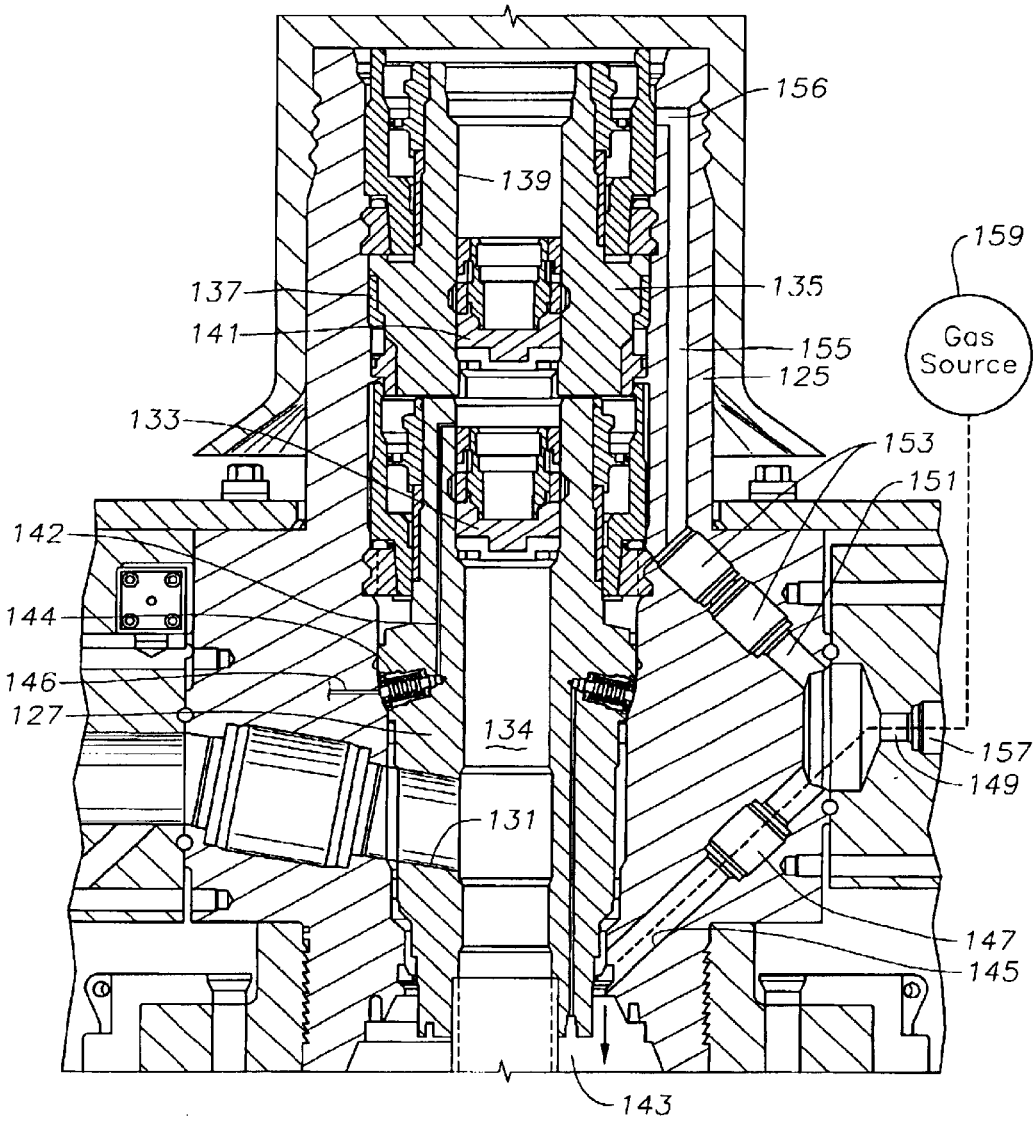
FIG. 4 is another embodiment of a horizontal tree constructed in accordance with this invention.

FIG. 4 shows another embodiment of the invention, including a tree 125 having a tree mandrel 126 on its upper end and a tubing hanger 127 located within its bore 129. Tubing hanger 127 has a lateral production passage 131 as in the other embodiment. A single retrievable plug 133 locates within the axial passage 134 of tubing hanger 127, rather than two as in the embodiments.

An internal tree cap 135 is employed in this embodiment as a second safety barrier to plug 133. Internal tree cap 135 is locked in tree bore 129 above tubing hanger 127 and sealed by a seal 137. Tree cap 135 may be a solid member or it may have an axial passage 139, as shown. In the embodiment shown, tree cap 135 may be the same as secondary lockdown 33 (FIG. 1) except that it has it is sealed to tree bore 129 by seal 137. A retrievable plug 141 is sealingly landed within passage 139 of tree cap 135. To avoid hydraulic lock while installing tree cap 135 while containing plug 141, a vent port 142 leads from tubing hanger axial passage 134 above plug 133 to a seal 144 on the side wall of tubing hanger 127. Seal 144 has a check valve and may be the same as seal 67 of FIG. 1. Seal 144 engages tree bore 129 and connects vent port 142 to a vent port 146 leading through tree 125 to the exterior. Vent port 142 also avoids hydraulic lock while landing plug 141 in previously installed internal tree cap 135. Furthermore, vent port 142 enables pressure testing of primary crown plug 133.

Tubing annulus 143 communicates with a lower or first passage 145 that leads upward in the body of tree 125 to a port 149 on the exterior. First tubing annulus passage 145 has a hydraulically actuated valve 147 therein. A second or upper tubing annulus passage 151 joins first passage 145 at port 149 and leads upward within tree 125. In this embodiment, second tubing annulus passage 151 has two hydraulically actuated valves 153 in series. Second tubing annulus passage 151 has an upper axial portion 155 that extends upward within the side wall of tree mandrel 126 parallel with an axis of tree bore 129. Upper portion 155 has a lateral port at its upper end that leads into tree bore 129 above internal tree cap seal 137. An external valve 157 is connected to external port 149. A gas source 159 may optionally be connected to valve 157. If a gas source 159 is not to be utilized, one of the valves 153 in second tubing annulus passage 151 maybe omitted.

Access from a workover riser to tubing annulus 143 is through tubing annulus passages 155, 151 and 145. Gas may be injected from gas source 159 in the same manner as in the other embodiments. If so, both valves 153 will be closed to provide dual pressure barriers. Valves 157 and 147 are opened to flow gas through lower tubing annulus passage 145 into tubing annulus 143.

Figure 5:
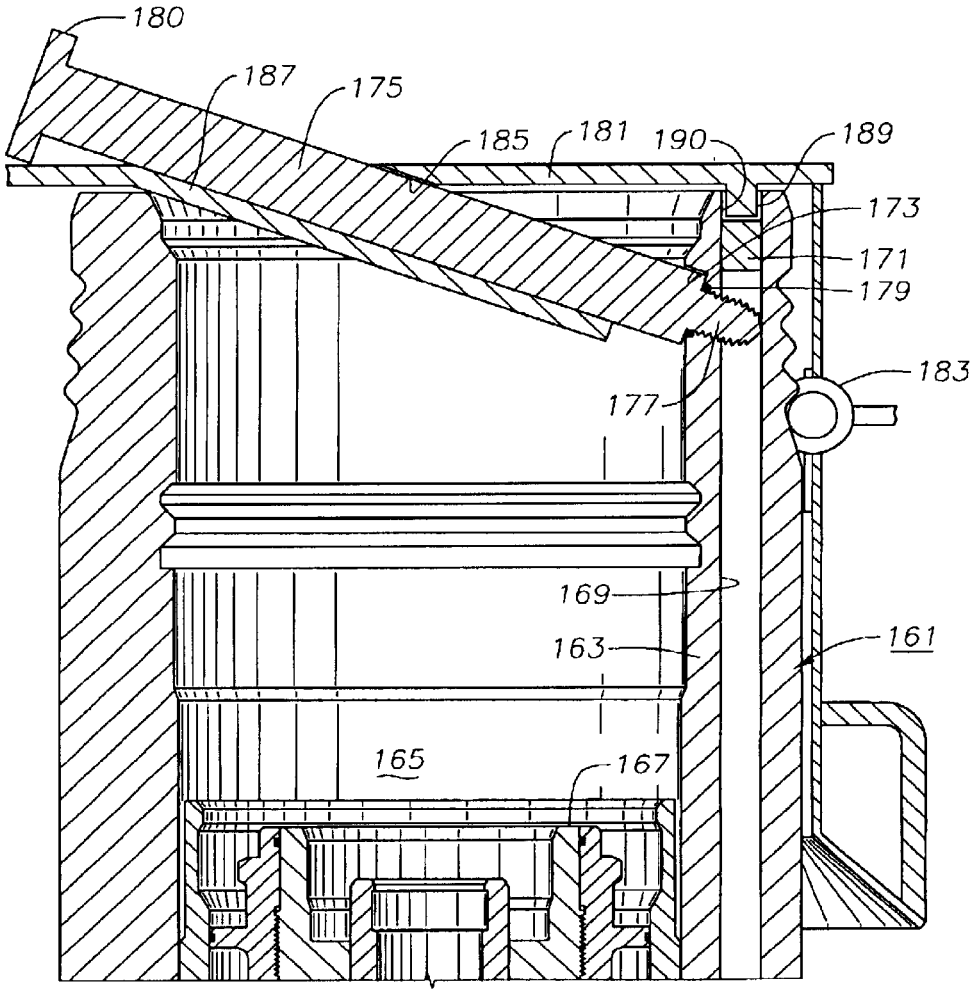
FIG. 5 is an enlarged sectional view of an upper portion of another embodiment of a tree in accordance with this invention, showing a removable plug as a second safety barrier for the second tubing annulus passage.

FIG. 5 shows another embodiment of the invention, including a tree 161 that has a mandrel 163 on its upper end with a bore 165. A tubing hanger assembly 167 is landed and sealed within bore 165 in the same manner as tubing hanger assembly 21 of FIG. 1. Although not shown, a lower or first tubing annulus passage, such as passage 145 of FIG. 4, will lead to an exterior port, such as port 149 in FIG. 4. A second tubing annulus passage leads from port 149 and has an upper portion 169 that extends within the cylindrical sidewall of mandrel 163 parallel with the longitudinal axis of bore 165. Annulus passage 169 leads to the upper end or rim of tree 161, but is plugged at the upper end by a permanent plug 171. A lateral port 173 leads from the axial portion of tubing annulus passage 169 into bore 165 a short distance below the upper end of tree 161. Lateral portion 173 has an axis that is at an acute angle relative to a plane perpendicular to the longitudinal axis of bore 165.

A plug 175 has a lower end that selectively closes lateral port 173, and thus the upper end of tubing annulus passage 169. Plug 175 is removable in this embodiment and installed by an ROV. Plug 175 has a threaded stem 177 on its lower end that engages mating threads in lateral port 173. A seal 179 is located on the lower end of plug 175 for sealing plug 175 within lateral portion 173. Plug 175 extends diagonally across tree bore 165 from lateral port 173 and preferably has a length sufficient so that its upper end 180 protrudes above the upper end of tree mandrel 163 in the installed position. Upper end 180, which is shown schematically, preferably has a profile for gripping by a conventional ROV. The length of plug 175 from upper end 180 to threaded stem 177 is greater than the inner diameter of tree mandrel 163 in this embodiment.

A corrosion cap 181 lands on mandrel 163 and is secured by lock 183 as in the other embodiments. As in the other embodiments, corrosion cap 181 does not seal the interior of bore 165 from external pressure, but provides protection against the entry of debris. Corrosion cap 181 has an aperture 185 for the entry of plug 175. If desired, an inclined guide 187 may be formed on the lower side of corrosion cap 181 at the same angle of inclination as tubing annulus passage lateral portion 173. Corrosion cap 181 may have a key 189 for orienting guide 187 and aperture 185 with tubing annulus lateral port 173. In this embodiment, permanent plug 171 is installed slightly below the upper end of tree mandrel 163, providing a recess 190 for receiving key 189.

So as to provide clearance for plug 175, the embodiment of FIG. 5 does not show a lockdown assembly such as secondary lockdown 33 of FIG. 1 or an internal tree cap, such as internal tree cap 135 of FIG. 4. The embodiment of FIG. 5 would not need two hydraulically actuated valves 153 (FIG. 4) because plug 175 serves as a second safety barrier for second tubing passage 169. Furthermore, if gas is not to be injected through the external port, such as port 149 of FIG. 4, there would be no need for either of the valves 153 of FIG. 4. One safety barrier would be provided by valve 147 in first tubing annulus passage 145 and the second safety barrier would be provided by plug 175.

In the operation of the embodiment of FIG. 5, plug 175 is installed after the well has been completed and the riser removed. First corrosion cap 181 is installed and oriented with key 189 in recess 190. Then, plug 175 is passed through aperture 185 along guide 187 into engagement with lateral port 173. The ROV rotates plug 175 to secure threads 177 within tubing annulus passage lateral port 173.

Figure 6:
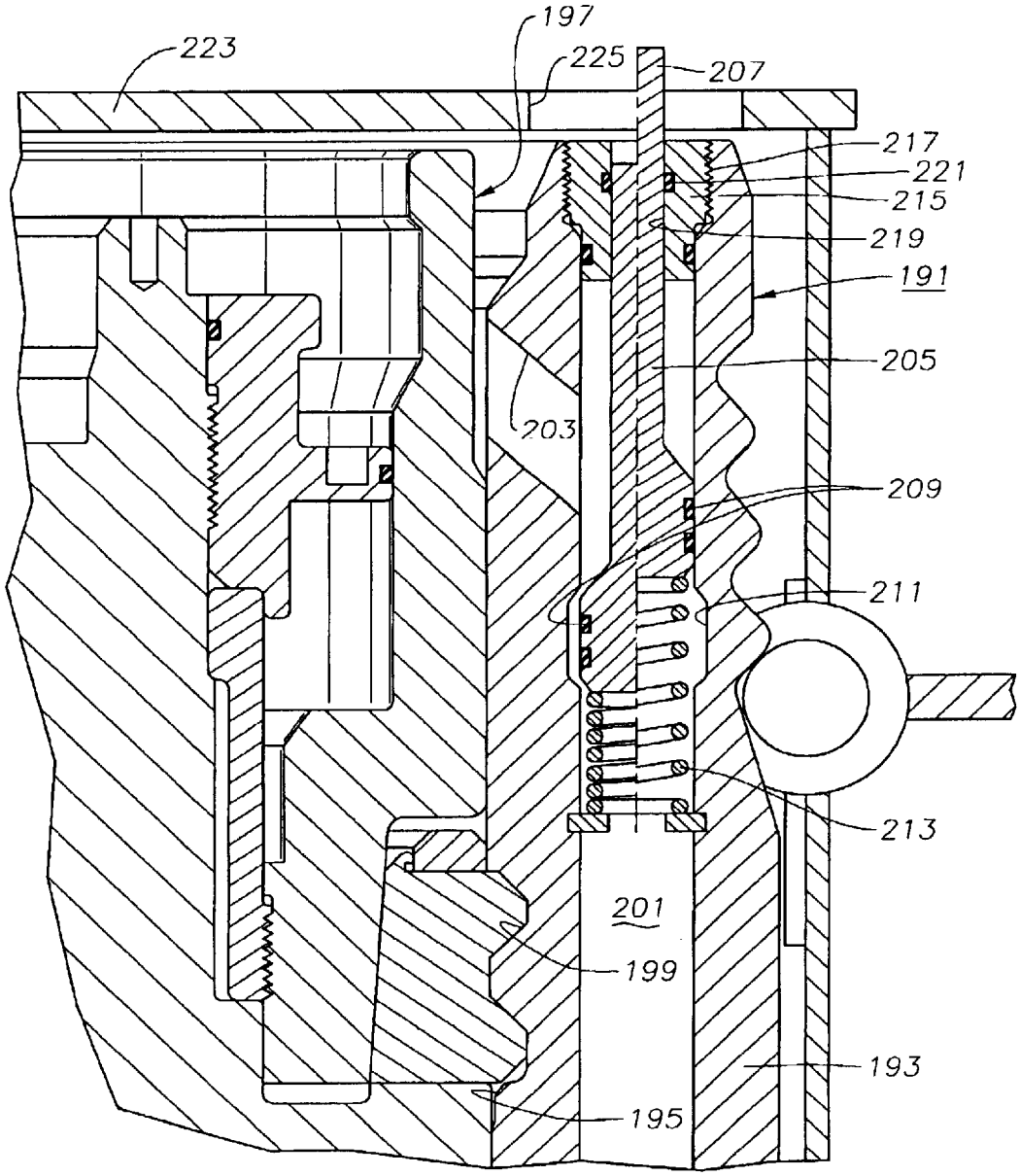
FIG. 6 is an enlarged partial sectional view of still another embodiment of a tree in accordance with this invention, showing a check valve in the upper end of the second tubing annulus passage.

FIG. 6 shows still another embodiment of the invention, including a tree 191 with a mandrel 193 and bore 195. A lockdown assembly 197 is shown engaging an internal profile 199 in bore 195. Lockdown assembly 197 could be omitted, if desired. The axial upper portion of a tubing annulus passage 201 extends within the sidewall of mandrel 193 parallel to its axis. A lateral port 203 leads from annulus passage 201 to tree bore 195. The axis of lateral port 203 is at an acute angle relative to a plane perpendicular to the longitudinal axis of bore 195.

The second safety barrier in this instance comprises a shuttle valve 205 that is located in the axial portion of tubing annulus passage 201 near the upper end of mandrel 193. Valve 205 has an upward protruding stem 207 and a lower portion with seals 209. While in the upper position, which is shown on the right side of valve 205, seals 209 will engage and seal against the annulus passage 201. Both seals 209 seal against tubing annulus passage 201 below the junction with lateral port 203, thus blocking communication between port 203 and the lower portion of tubing annulus passage 201. While in the lower position, shown on the left, seals 209 will locate within an enlarged recess 211 of annulus passage 201. Fluid is allowed to flow around seals 209 while in the lower position, thereby communicating the lower portion of tubing annulus passage 201 with lateral port 203.

The movement between the upper and lower positions of valve 205 could be operated hydraulically, however preferably valve 205 is biased to the upper closed position by a coil spring 213. Stem 207 slides through a passage 219 in a bushing 215 in tubing annulus passage 201 at the upper end of tree mandrel 193. Bushing 215 is secured by threads 217 to the upper end of tubing annulus passage 201. A seal 221 in passage 219 seals stem 207 to bushing 215.

A corrosion cap 223 fits over mandrel 193 as in the other embodiments. Corrosion cap 223, however, has a hole 225 to allow the passage of stem 207 of valve 205 while it is in the upper closed position. Corrosion cap 223 thus is oriented while being installed.

Tubing annulus passage 201 leads downward to an external port, such as port 149 of FIG. 4. A lower tubing annulus passage, such as passage 145 of FIG. 4, leads from the tubing annulus to the external port. The lower tubing annulus passage will have a hydraulically actuated valve, such as valve 147 of FIG. 4. If gas injection is desired, the lower portion of upper tubing annulus passage 201 will preferably have one hydraulically actuated valve, such as valve 153 (FIG. 4). Shuttle valve 205 serves as a second closure or safety barrier when the lower tubing annulus passage valve, such as valve 147 is open. If gas injection is not to be used, the valve in the lower portion of upper tubing annulus passage 201 (valve 153 in FIG. 4) will not be needed.

In the operation of the embodiment of FIG. 6, valve 205 will be installed with tree 191 prior to lowering tree 191 onto the wellhead housing. The riser connector (not shown) that connects to tree 191 for lowering it will engage stem 207 and push valve 205 to the lower position. Consequently, during the installation and completion process, tubing annulus passage 201 will be open to bore 195 through lateral port 203. Communication is achievable between the tubing annulus passage 201 and the surface by means of a choke and kill line previously discussed.

After the well is completed, the riser connector is disconnected, resulting in spring 213 pushing stem 207 back to the upper closed position. This closes the upper end of tubing annulus passage 201, providing a safety barrier. Corrosion cap 223 is installed with hole 225 registering over stem 207, allowing valve 205 to remain in the upper closed position.

The invention has significant advantages. Gas lift injection may be performed with dual safety barriers and without the use of an internal tree cap. Using a plug as a tubing annulus safety barrier rather than a hydraulically actuated valve is less expensive. The plug is removed and installed by an ROV. Furthermore, the spring biased valve embodiment automatically opens and closes when engaged by a riser connector. Venting through the tubing hanger into a vent passage in the tree provides an effective way to avoid hydraulic lock and test a crown plug in the tubing hanger. The secondary lockdown provides an additional safety as well as providing a landing for a wireline riser.

While the invention has been shown in only a few of its forms, it should be apparent to those skilled in the art that it is not so limited but susceptible to various changes without departing from the scope of the invention.

We claim:

1. In a wellhead assembly having a production tree with a bore into which a tubing hanger lands and is sealed by a tubing hanger seal, the tubing hanger adapted to be connected to a string of tubing, defining a tubing annulus, the tubing hanger having an axial passage with a lateral production port that registers with a lateral production passage in the tree for the flow of production fluid from the tubing, the improvement comprising:

a first portion of a tubing annulus passage extending upward through a portion of the tree from the tubing annulus to an exterior port, the exterior port adapted to be connected to a source of fluid for injection into the tubing annulus;

a second portion of the tubing annulus passage extending upward through a portion of the tree from the exterior port to the bore of the production tree above the tubing hanger seal;

a lower valve in the first portion of the tubing annulus passage for selectively opening and closing the first portion of the tubing annulus passage;

the bore above the tubing hanger seal being free of any additional seals, exposing the tubing hanger above the tubing hanger seal to ambient pressure that exists externally of the tree; and two closure members located in the second portion of the tubing annulus passage outside of the bore of the tree in series with each other, for selectively opening and closing the second portion of the tubing annulus passage.

2. The wellhead assembly according to claim 1, wherein at least one of the closure members comprises a valve.

3. The wellhead assembly according to claim 1, wherein both of the closure members comprise hydraulically actuated valves.

4. The wellhead assembly according to claim 1, wherein:

the tree has a tubular mandrel that extends above the tubing hanger;

the second portion of the tubing annulus passage extends upward within a sidewall of the mandrel and enters the bore of the tree adjacent an upper end of the mandrel;

one of the closure members comprises a hydraulically actuated valve positioned in the tree near the exterior port; and the other of the closure members is mounted near the upper end of the mandrel.

5. The wellhead assembly according to claim 4, wherein the closure member mounted near the upper end of the mandrel comprises an ROV removable plug.

6. The wellhead assembly according to claim 4, wherein:

the closure member mounted near the upper end of the mandrel comprises an upward biased valve that has a stem that protrudes above a rim of the mandrel while the upward biased valve is in a closed position, the stem adapted to be contacted by a riser connector to move the upward biased valve downward to an open position.

7. The wellhead assembly of claim 1, further comprising:

a secondary lockdown assembly secured to a profile in the bore of the tree above the tubing hanger, the lockdown assembly having an axial passage therethrough and an upward protruding neck with an exterior profile on the neck; and a riser connector selectively coupled to the exterior profile on the neck for providing access to the axial passage of the tubing hanger.

8. In a wellhead assembly having a production tree with a mandrel having a bore into which a tubing hanger lands and is sealed by a tubing hanger seal, the tubing hanger adapted to be connected to a string of tubing, defining a tubing annulus, the tubing hanger having an axial passage and a lateral production port that registers with a lateral production port in the tree for the flow of production fluid from the tubing, the improvement comprising:

a tubing annulus passage extending upward through a portion of the tree from the tubing annulus, the tubing annulus passage having an upper portion that is located within a sidewall of the mandrel alongside and separate from the bore and leads into the bore above the tubing hanger seal adjacent an upper end of the mandrel; and a closure member located in the upper portion of the tubing annulus passage adjacent the upper end of the mandrel for selectively opening and closing the upper portion of the tubing annulus passage.

9. The wellhead assembly of claim 8, wherein the closure member comprises a valve.

10. The wellhead assembly of claim 8, wherein the closure member comprises a removable plug.

11. The wellhead assembly of claim 8, wherein:

the upper portion of the tubing annulus passage has an axial portion parallel to an axis of the bore and a lateral portion that is inclined upward relative to a plane perpendicular to the axis of the bore, the lateral portion leading into the bore; and the closure member comprises a removable plug located with the lateral portion.

12. The wellhead assembly of claim 11, further comprising a corrosion cap located on an upper end of the mandrel, the corrosion cap having an aperture and an inclined guide aligned with the lateral portion; and wherein the plug extends through the aperture and along the guide for insertion and removal from the lateral portion while the corrosion cap remains on the upper end of the mandrel.

13. In a wellhead assembly having a production tree with a mandrel having a bore into which a tubing hanger lands and is sealed by tubing hanger seals, the tubing hanger adapted to be connected to a string of tubing, defining a tubing annulus, the tubing hanger having an axial passage and a lateral production port that registers with a lateral production port in the tree for the flow of production fluid from the tubing, the improvement comprising:

a tubing annulus passage extending upward through a portion of the tree from the tubing annulus, the tubing annulus passage having an upper portion that is located within a sidewall of the mandrel and leads into the bore adjacent an upper end of the mandrel;

a closure member located in the upper portion of the tubing annulus passage adjacent the upper end of the mandrel for selectively opening and closing the upper portion of the tubing annulus passage; and wherein the closure member comprises an upward-biased valve that has a stem that protrudes above a rim of the mandrel while the valve is in a closed position, the stem adapted to be contacted by a riser connector to move the valve downward to an open position.

14. The wellhead assembly of claim 13, further comprising a corrosion cap that fits over the mandrel, the corrosion cap having a hole therethrough for receiving the stem.

15. The wellhead assembly of claim 8, wherein:

the tubing annulus passage has a first portion leading from the tubing annulus to an external port, the external port adapted to be connected to a source of injection fluid;

a lower end of the upper portion of the tubing annulus passage joins the external port; and a hydraulically actuated valve is located in the upper portion of the tubing annulus passage adjacent the lower end of the upper portion of the tubing annulus passage.

16. The wellhead assembly of claim 8, further comprising:

a lockdown assembly secured without seals to a profile in the bore of the tree above the tubing hanger, the lockdown assembly having an axial passage therethrough and an upward protruding neck with an exterior profile on the exterior of the neck; and a riser connector selectively coupled to the exterior profile on the lockdown assembly for providing workover access to the axial passage of the tubing hanger.

17. In a wellhead assembly having a production tree with a mandrel having a bore into which a tubing hanger lands and is sealed by tubing hanger seals, the tubing hanger having an axial passage and a lateral passage leading therefrom for production flow, the improvement comprising:

a secondary lockdown assembly secured to a profile in the bore of the tree above the tubing hanger for preventing upward movement of the tubing hanger, the lockdown assembly having an axial passage therethrough that aligns with the axial passage of the tubing hanger, the lockdown assembly having an upward protruding neck with an exterior profile on the exterior of the neck;

a riser connector selectively coupled to the exterior profile on the lockdown assembly for providing access to the axial passage of the tubing hanger; and wherein the bore above the tubing hanger is free of any seals so as to expose the tubing hanger above the tubing hanger seals to ambient pressure that exists on the exterior of the tree.

18. The wellhead assembly according to claim 17 wherein the riser connector has a tubular stinger that passes through the axial passage of the lockdown assembly and sealingly engages the axial passage of the tubing hanger.

19. The wellhead assembly according to claim 17 wherein the riser connector has a portion that has a diameter larger than a diameter of the bore of the tree.

20. A method of injecting a fluid into a tubing annulus of a wellhead assembly having a production tree with a bore into which a tubing hanger lands and is sealed by a tubing hanger seal, the tubing hanger being connected to a string of tubing, defining the tubing annulus, the method comprising:

(a) providing a first portion of a tubing annulus passage extending upward through a portion of the tree from the tubing annulus to an exterior port;

(b) providing a second portion of the tubing annulus passage extending upward through a portion of the tree from the exterior port to the bore of the production tree above the tubing hanger seal;

(c) providing a lower valve in the first portion of the tubing annulus passage and opening the lower valve;

(d) providing an upper valve in the second portion of the tubing annulus passage and a closure member in the second portion of the tubing annulus passage above and in series with the upper valve;

(e) closing the closure member and the upper valve; and (f) injecting a fluid through the exterior port, which flows through the first portion of the tubing annulus passage into the tubing annulus.

21. The method according to claim 20, wherein step (d) comprises:

with the assistance of an ROV, inserting a plug into an upper end of the second portion of the tubing annulus passage where it joins the bore.

22. The method according to claim 20, wherein step (d) comprises:

providing a check valve in an upper end of the second portion of the tubing annulus passage; and biasing the check valve to a closed position.

23. A method of providing access to a tubing annulus in a wellhead assembly having a production tree with a mandrel having a bore into which a tubing hanger lands and is sealed by tubing hanger seals, the tubing hanger being connected to a string of tubing, defining the tubing annulus, the method comprising:

(a) providing a tubing annulus passage extending upward through a portion of the tree within a sidewall of the mandrel from the tubing annulus and into the bore above the tubing hanger seals; and (b) installing a closure member in the tubing annulus passage outside of the bore and adjacent an upper end of the mandrel; then, for access to the tubing annulus, (c) opening the closure member.

24. The method according to claim 23, wherein step (b) comprises mounting a valve in the tubing annulus passage adjacent an upper end of the tubing annulus passage.

25. The method according to claim 23, wherein step (b) comprises inserting a plug into an upper end of the tubing annulus passage; and step (c) comprises removing the plug.

26. The method according to claim 23, wherein:

step (a) comprises providing the tubing annulus passage with a lateral portion that is inclined upward relative to a plane perpendicular to the axis of the bore, the lateral portion leading into the bore;

step (b) comprises inserting a removable plug into the lateral portion; and step (c) comprises removing the plug from the lateral portion.

27. The method according to claim 23, wherein:

the wellhead assembly has a corrosion cap located on an upper end of the mandrel;

step (b) comprises providing the corrosion cap with an aperture and an inclined guide aligned with the lateral portion; and step (c) comprises inserting the plug through the aperture and along the guide into the lateral portion.

28. The method according to claim 23, wherein:

step (b) comprises installing in the tubing annulus passage an upward-biased valve that has a stem that protrudes above a rim of the mandrel while the valve is in a closed position; and step (c) comprises landing a riser connector on the rim, thereby pressing the stem downward to an open position.

29. A method of connecting a workover riser to a wellhead assembly having a production tree with a mandrel having a bore into which a tubing hanger lands and is sealed by tubing hanger seals, the tubing hanger having an axial passage and a lateral passage extending therefrom for production fluid flow, the tubing hanger having at least one removable plug in the axial passage above the lateral passage, the improvement comprising:

securing a lockdown assembly to a profile in the bore of the tree above the tubing hanger, the lockdown assembly having an axial passage therethrough and an upward protruding neck with an exterior profile on the exterior of the neck;

exposing the tubing hanger above the tubing hanger seals to ambient pressure that exists on the exterior of the tree;

connecting a riser to the exterior profile on the lockdown assembly; then removing the plug through the riser.

30. In a wellhead assembly having a production tree with a mandrel having a bore into which a tubing hanger lands and is sealed by a tubing hanger seal, the tubing hanger adapted to be connected to a string of tubing, defining a tubing annulus, the tubing hanger having an axial passage and a lateral production port that registers with a lateral production port in the tree for the flow of production fluid from the tubing, the improvement comprising:

a lower tubing annulus passage extending upward through a portion of the tree from the tubing annulus to an exterior port, the exterior port adapted to be connected to a source of fluid for injection into the tubing annulus;

a lower hydraulically actuated valve located in the lower tubing annulus passage;

an upper tubing annulus passage extending upward through a portion of the tree from the exterior port through a sidewall of the mandrel and into the bore above the tubing hanger seal adjacent an upper end of the mandrel;

an upper hydraulically actuated valve located in the upper tubing annulus passage adjacent the exterior port; and a closure member located in the upper tubing annulus passage outside of the bore and in series with the valve for selectively opening and closing the upper portion of the tubing annulus passage.

31. The wellhead assembly of claim 30, wherein the closure member comprises a valve.

32. The wellhead assembly of claim 30, wherein the closure member comprises an ROV removable plug.

* * * * *

UNITED STATES PATENT AND TRADEMARK OFFICE

CERTIFICATE OF CORRECTION

PATENT NO. : 6,763,891 B2
DATED : July 20, 2004
INVENTOR(S) : Bernard Humphrey et al.

It is certified that error appears in the above-identified patent and that said Letters Patent is hereby corrected as shown below:

Column 4,
Line 9, delete “a” before “two”
Line 60, delete “are” before “used” and insert -- is --

Column 6,
Line 53, delete “it has”

Signed and Sealed this

Seventh Day of December, 2004

JON W. DUDAS
*Director of the United States Patent and Trademark Office*